US005204722A

United States Patent [19]

Thompson et al.

[11] Patent Number: 5,204,722

[45] Date of Patent: Apr. 20, 1993

[54] THERMO-ELECTRIC TRANSFER SYSTEM FOR LIQUID TONER

[75] Inventors: John A. Thompson; Kenneth E. Heath, both of Boise, Id.

[73] Assignee: Hewlett-Packard Company, Palo Alto, Calif.

[21] Appl. No.: 932,092

[22] Filed: Aug. 19, 1992

[51] Int. Cl.[5] ..... G03G 15/14; G03G 15/20

[52] U.S. Cl. ..... 355/279; 355/271; 355/290

[58] Field of Search ..... 355/279, 271, 256, 258, 355/290, 326; 118/645, 661; 430/99, 124

[56] References Cited

U.S. PATENT DOCUMENTS

| | | | |
|---|---|---|---|
| 4,518,976 | 5/1985 | Tarumi et al. . | |
| 5,021,829 | 6/1991 | Johnson et al. | 355/271 X |
| 5,057,875 | 10/1991 | Itoh | 355/279 X |
| 5,115,227 | 5/1992 | Camis | 355/279 X |
| 5,136,334 | 8/1992 | Camis et al. | 118/645 X |
| 5,150,161 | 9/1992 | Bujese | 355/271 X |
| 5,153,656 | 10/1992 | Johnson et al. | 355/271 X |
| 5,162,854 | 11/1992 | Hilbert et al. | 118/645 X |

*Primary Examiner*—R. L. Moses

[57] ABSTRACT

A thermo-electric image transfer system (50) for transferring a toned image directly to a paper or transparency medium in the absence of a liquid toner carrier. The medium is fed over a pre-heating platen (52) which drives excess moisture out of the medium. The medium is fed into a nip between first and second transfer rollers (64, 62). The first transfer roller (64) is heated so as to heat the backside of the medium, and includes a thermally and electrically conductive elastomeric layer (64A). A guide element (66) guides the medium out of the nip between the transfer rollers, and into another nip between the first transfer roller (64) and the photoconductor drum (68), with pneumatic cylinders maintaining pressure between the roller and drum. An electrostatic bias voltage is applied to the first roller (64) of a polarity opposite to that of the toner defining the image on the drum (68), to provide an electrostatic attraction of toner to the medium. The heat, pressure and electrostatic fields causes a toner image to be transferred to the medium from the drum (68). The medium is allowed to remain against the drum (68) to allow for cooling and adhesion to the medium, and thereafter is detached from the drum, with the image separating at the toner/-photoconductor interface.

18 Claims, 2 Drawing Sheets

THERMO-ELECTRIC TRANSFER SYSTEM FOR LIQUID TONER

BACKGROUND OF THE INVENTION

The present invention relates to a system for transferring a toned image directly from a photoconductor to paper or transparency material using a liquid toner electrophotographic process, and in the absence of a liquid toner carrier on the transfer medium (e.g., paper).

Electrophotographic Processes are known which employ dry powder toners; other processes employ liquid toners. The principle difference between these two toners is how the pigment/binder particles are charged and the state of the carrier.

In dry powder toners, the charge is created by triboelectric charging (e.g., contacting polymers of different types to create charge exchange). The carrier in this case can be just a surface, roller, or particulate in nature. The developer mechanism which handles the toner provides the necessary contact for charging.

In liquid toners, charge control agents are chemically added to the carrier containing the pigment/binder components. The subsequent chemical reaction between the charge control agents and pigment/binder components results in the charging of the pigment-/binder components. The liquid toner remains electrically neutral; however, once an electric field is applied both polarities migrate toward the opposite electrodes. This process is called electrophoresis. This is why previous transfer devices used carrier-wetted paper to allow for the mobility of the toner particles and counter charges. Images dried completely become neutral as there is no charge mobility without the liquid carrier. By using thermo-electric transfer of very dry images, some improvement is observed when utilizing electrical fields to aid thermal transfer over strictly a thermal approach. However, very dry images do not have enough charge mobility to provide the 100% transfer necessary for color image transfer. To obtain the appropriate color densities and hue, it is not only necessary to develop to appropriate densities for each hue, but it is also necessary to transfer consistent color densities to ensure that red remains red, green remains green, and so on. With less than 100% transfer, consistent color densities will not be transferred.

"Liquid toner" is a term that generally includes both the pigment/binder system and the insulating liquid; the insulating liquid is also referred to as the "liquid carrier." The liquid carrier may, for example, comprise paraffinic solvent blends of aliphatic, cycloalipatic, aromatic and halogenated hydrocarbons. These liquids are chosen because they are non-polar and, consequently, have a low dielectric constant and high electrical resistivity. Commercially available liquid toners include those sold under the trademarks "ISOPAR" and "NORPAR" by Exxon Corporation.

Direct transfer to paper in the absence of the liquid toner carrier has not been attempted by others. There has been electrostatic transfer from photoconductor to paper in the prior art; however, the paper was "wetted" with a liquid toner carrier. Insofar as in known, thermo-electric transfer of very dry images has not heretofore been attempted. "Very dry images" contain no less than 50% solids. Typically, in liquid development systems the "image areas," e.g., the areas in which pigment-/binder are electrostatically developed, contain approximately 25% solids and 75% liquid carrier. However, with subsequent drying techniques, images with no less than 50% solids can be attained.

The advantage of direct, thermo-electric transfer is process simplicity and, thereby, product cost. Previous implementations either ignored the unacceptable problem of transferring wet images to paper, or used an intermediate transfer technique, a more complex and expensive approach. An intermediate transfer system is a transfer system whereby he image developed onto the photoconductor is transferred to an intermediate belt or roller mechanism and, subsequently, to paper. This results in two separate transfers which can utilize electrostatics or thermal processes.

SUMMARY OF THE INVENTION

A thermo-electric image transfer system is disclosed for directly transferring a toned image formed on a photoconductor drum to a sheet medium, wherein the toner has an electrostatic polarity. The sheet medium is fed over a heated platen to drive out excess moisture, into the nip between first and second heated transfer rollers. The first transfer roller contacts the image side of the medium, and provides a means for heating this side to a temperature in excess of the melting temperature of the liquid toner. The second roller has an outer elastomeric layer which is thermally and electrically conductive, and provides a means for heating the backside of the medium, raising the bulk temperature as well as the surface temperature to control the subsequent cooling rate.

The system further comprises a means for guiding the medium out of the nip between the transfer rollers and into contact with the photoconductor drum, wherein contact is maintained between the elastomeric layer and the medium until the medium contacts the photoconductor drum at a second nip between the second roller and the drum. Means are further provided for applying an electrostatic voltage to the second roller which is opposite in polarity to the polarity of the toner, thereby providing an electrostatic attraction of the toner to the medium.

As the medium is pressed against the drum by the second roller, the toner defining the image on the drum is softened, and becomes somewhat tacky at the interface between the medium and the toner image, and is electrostatically attracted to the medium. The medium is allowed to remain against the drum after passing through the second nip to allow for cooling and adhesion to the medium. The medium is then detached from the drum with the image adhered to the medium.

BRIEF DESCRIPTION OF THE DRAWING

These and other features and advantages of the present invention will become more apparent from the following detailed description of an exemplary embodiment thereof, as illustrated in the accompanying drawings, in which.

DETAILED DESCRIPTION OF THE PREFERRED EMBODIMENT

Figure 1:
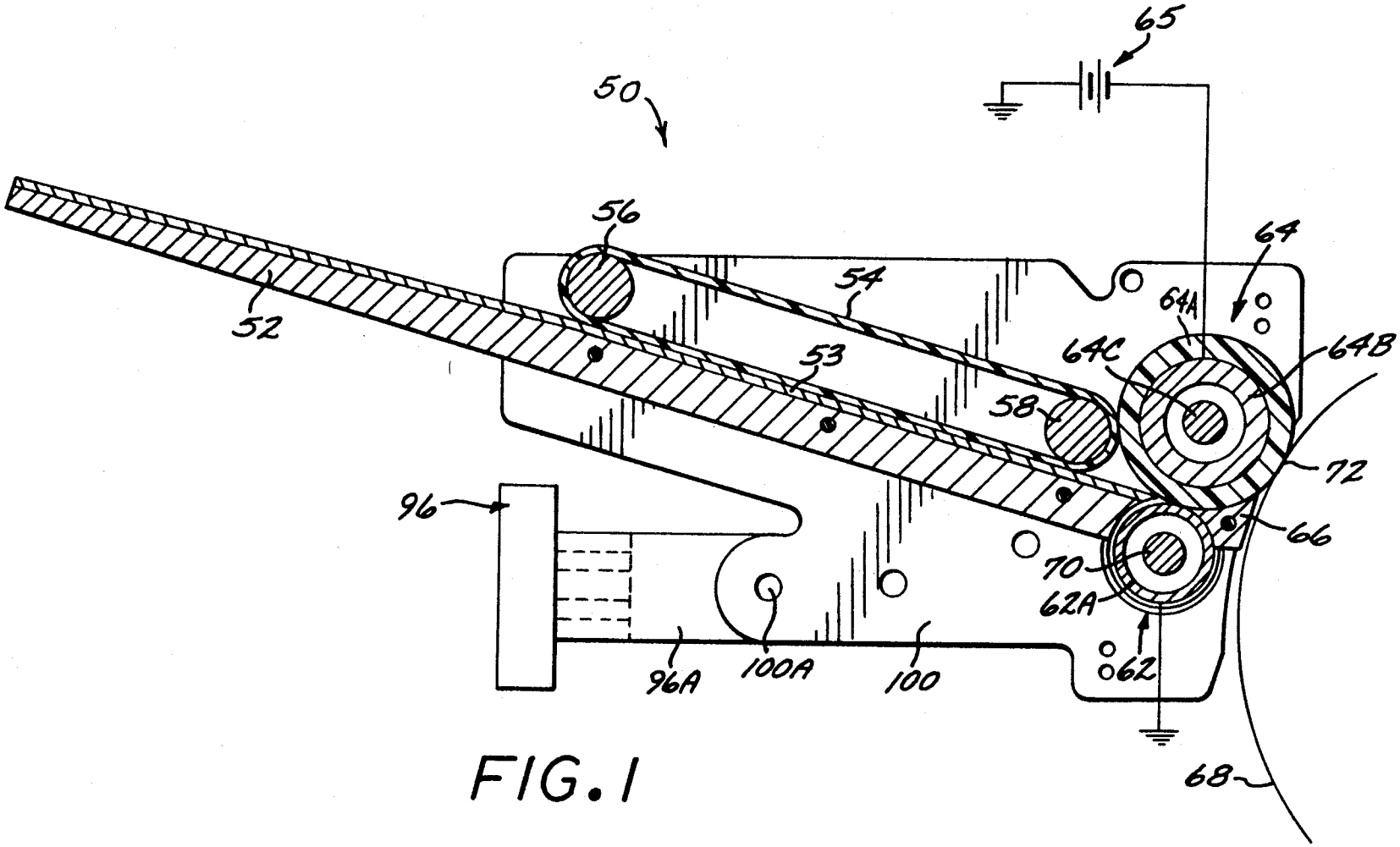
FIG. 1 is a cross-sectional view of a thermo-electric transfer system in accordance with the invention.

FIG. 1 illustrates in cross-section a thermo-electric transfer system 50 embodying the present invention. The system 50 includes a paper preheat platen 52, and a means for feeding the paper along the platen 52 into the nip 60 between rollers 62 and 64. The feeding means includes a paper feed belt 54, supported and driven by paper feed belt drive rollers 56 and 58, in turn driven by conventional external drive means (not shown). A paper guide and stripper 66 directs the paper into engagement with the photoconductor drum 68.

A platen heating means is provided for heating the platen to and maintaining the platen temperature at a substantially constant temperature, e.g., 90° C. in this embodiment. The purpose of heating the platen is to drive out excess moisture from the paper, particularly on the side to which the toner is to be transferred. The surface of platen 52 which interfaces with the paper feed belt 54 is heated via a resistive blanket 53 mounted on the surface of platen 52. Such blanket heaters are commercially available, e.g., the model KH-808 available from Omega Engineering, Inc., Stamford, Conn. 06906. An electrical feedback is provided by a thermocouple also mounted on surface 52 to an electrical circuit (not shown) which modulates the current passing through the heater blanket.

The roller 62 comprises a hollow aluminum roller element 62A. Disposed at the center of the hollow roller 62 is a transfer roller heater 70, which in this embodiment comprises a quartz halogen lamp. The roller element 62A is arranged to rotate about the heater element 70, which remains stationary. The image side of the paper is heated by the aluminum roller 62 to a temperature in excess of the glass transition temperature $T_g$ of the liquid toner.

The roller 64 comprises an elastomeric layer 64A formed over a hollow aluminum roller element 64B. Another transfer roller heater 64B is disposed inside the hollow roller 64B, and also comprises a quartz halogen lamp. The heater 64C heats the roller 64, so that at the nip 60, the backside of the paper is also heated by the thermally and electrically conductive elastomeric roller 64. This heating raises the bulk temperature as well as the surface temperature of the paper to control the subsequent cooling rate of the paper. The elastomeric roller is a silicone rubber material made conductive with the addition of carbon particles during the compounding process. Enough carbon loading is provided to result in a bulk resistivity of approximately $10^8$ ohm - cm.

The roller heater elements 64C and 70 are 250 watt quartz halogen lamps whose respective duty cycle is controlled by a thermocouple which rides the surface of the respective roller 62 and 64 through a feedback control circuit.

An electrostatic bias voltage is applied to the roller element 64B of the elastomeric roller 64 of a polarity opposite to that of the toner to provide an electrostatic attraction of toner to the paper. As schematically depicted in FIG. 1, the bias voltage is applied by a battery 65. In this example, a negative bias voltage is applied to the roller element 64B. The roller element 62A is connected to ground. For this example, the toner has a positive polarity.

The paper guide 66 guides the paper out of the nip 60, and serves the function of maintaining paper-to-elastomeric roller contact until the paper contacts the photoconductor at the nip 72. The nip 72 is formed between the elastomeric roller layer 64A and the photoconductor 68 under pressure provided by pneumatic cylinder 80, shown in FIG. 2. As in conventional image transfer systems, the photoconductor drum rotates so that the sheet medium comes into contact with the entire image formed on the drum. Once the paper has passed through the nip 72 under heat, pressure and electrostatic fields, the pigment/binder system of the toner is softened above its melt temperature, becomes somewhat tacky at the paper/toner interface at the nip 72, and is electrostatically attracted to the paper. A toner "decal" is formed, i.e., a film of toner which forms under the heat and pressure applied by roller 64.

The paper is allowed to remain against the photoconductor after passing through the nip 72 to allow for cooling and adhesion of the toner image to the paper. Once the toner has been cooled by the photoconductor drum, the paper is detached from the photoconductor with the image separating at the toner/photoconductor interface. Transfer is 100%, i.e., there is no remaining toner on the photoconductor.

The toned image is formed on the photoconductor image in the following manner. A latent electrostatic image is created on the surface of an insulating, photoconducting material by charging its surface and then selectively exposing areas of the surface to light. A difference in electrostatic charge density is created between the areas on the surface exposed and unexposed to light. The visible image is developed by chemically charged liquid toners containing pigment components dispersed in an insulating carrier liquid. The toners are selectively attracted to the photoconductor surface either exposed or unexposed to light depending on the relative electrostatic potentials of the photoconductor surface, development electrode and the toner charge polarity. The image on the photoconductor will contain small quantities of carrier (on the order of 40% by weight, or about 0.1 microliter per square centimeter, of the "toned" areas).

In order to facilitate removal of the toner from the drum surface, a low temperature release agent is preferably deposited on the drum surface before the toned image is formed. An exemplary release material is polydimethyl siloxane cross-linked with a polymonomethyl siloxane. The release agent is to keep toner from adhering to the photoconductor drum surface during the image transfer process.

Figure 2:
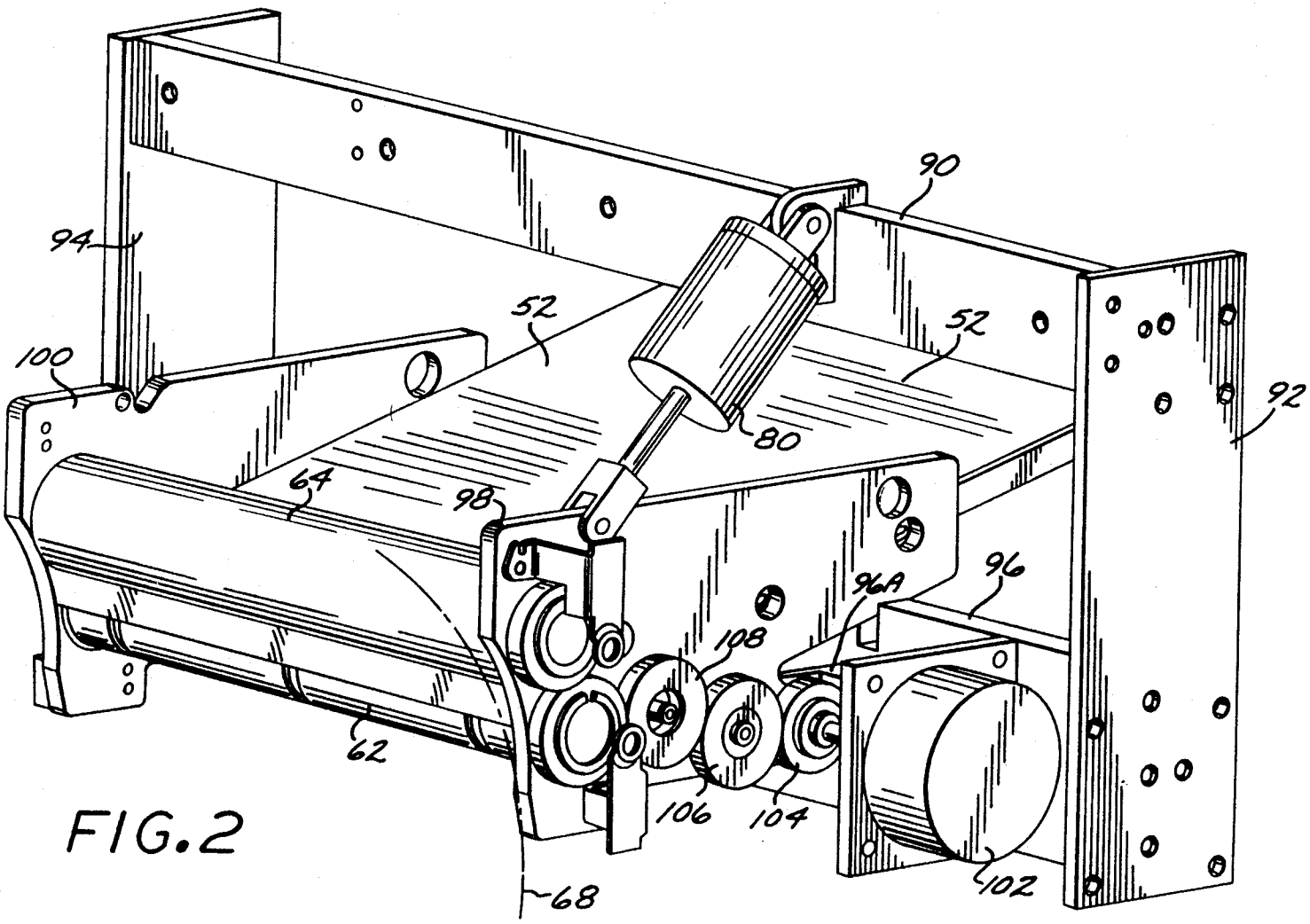
FIG. 2 is a perspective view of a portion of the system of FIG. 1.

FIG. 2 illustrates a perspective view of parts of the system 50; certain of the elements of FIG. 1 have been omitted for the sake of clarity. The system includes a structural frame assembly comprising upper cross member 90, upright side members 92 and 94, and a lower cross member and pivot block 96. The system 50 further comprises a pair of support members 98 and 100, which support the platen 52, secure the transfer rollers 62 and 64 for rotational movement, and support the paper feed drive rollers 56 and 58 (not shown in FIG. 2). The support members 98 and 100 have pivot points including pivot 100A (FIG. 1) which is pivotally secured to a boss 96A protruding from the lower cross member and pivot block 96.

A drive motor 102 is connected through an over-running clutch assembly 104 and through a pair of idler rollers 106 and 108 to the roller 62. The motor 102 is mounted on a flange 96B protruding from the lower cross member and pivot block 96. The over-running clutch is a device which engages a shaft when turning in one direction, but runs freely when turning in the opposite direction. The purpose of this clutch is to make sure that the transfer roll 64 turns at the same speed as the photoconductor drum 68. At low pressure the nip 72 may have insufficient friction to drive roller 64 at the photoconductor speed. The drive motor 102 and clutch assembly 104 ensure that torque is applied to the roller 64 without overdriving and causing a slip at the nip 72 to occur. The speed of motor 102 is set to drive the surface of roller 64 slightly less than the speed of the photoconductor drum 68. Without motor 102 the friction at the nip 72 is required to drive both rollers 64 and 67. This will allow slip when the nip pressure at nip 72 is low. To avoid slip, the motor 72 adds torque through gears 104, 106 and 108 to drive rollers 62 and 64. The slip clutch transmits torque but will not overdrive the rollers 62 and 64 since it is being driven at a speed slightly slower than the photoconductor drum 68.

Pneumatic cylinder 80 is connected between the upper cross member 90 and the top of the support member 98, and is extensible to apply a pressure on the elastomeric roller 64 to bear on the photoconductor drum 68. A second pneumatic cylinder (not shown for clarity) applies pressure to the opposite end of the roller 64 from cylinder 80. Loading of the roller 64 by other means, e.g., spring or cam loading, could alternatively be utilized. As the side members 98, 100 pivot about pivot block 96, the idler roller 106 rotates about the roller of the clutch 104, remaining in engagement therewith.

The image transfer system includes a photoconductor cleaning system (not shown) to remove any toner not transferred to the media by the image transfer process. The cleaning system can comprise, for example, a foam roller with a wetting agent such as liquid toner to wet the drum, and a cleaning wiper blade which includes an elastomeric material with an edge which comes into contact with and wipes the edge.

It is understood that the above-described embodiments are merely illustrative of the possible specific embodiments which may represent principles of the present invention. For example, a belt photoconductor may be employed instead of a drum. This would permit more flexibility in the design of a medium detaching device for detaching the medium from the photoconductor. Other arrangements may readily be devised in accordance with these principles by those skilled in the art without departing from the scope and spirit of the invention.

What is claimed is:

1. A thermo-electric image transfer system, for directly transferring an image formed by liquid toner on a photoconductor to a sheet medium in the absence of a liquid toner carrier applied to the sheet medium, comprising:

a photoconductor carrying an image defined by liquid toner applied to the surface thereof, said toner having an electrostatic polarity;

first and second heated transfer rollers defining a nip therebetween into which said medium is fed, providing a means for heating the image side of said medium to a temperature in excess of the melt temperature of said toner, the second of said rollers having an outer layer of a material which is thermally and electrically conductive, said heated second roller providing a means for heating the backside of said sheet media;

means for guiding said medium out of said nip between said transfer rollers and into contact with said photoconductor, said guiding means maintaining contact between said outer layer of said second roller and said medium until said medium contacts said photoconductor at a second nip between said second roller and said photoconductor; and means for applying an electrostatic voltage to said second roller which is opposite in polarity to that of said toner to provide an electrostatic attraction of the toner to said medium.

2. The system of claim 1 wherein said second heated transfer roller comprises a hollow metallic transfer roller coated with an elastomeric material forming said outer layer, and a transfer roller heat source disposed inside said hollow metallic transfer roller.

3. The system of claim 1 further comprising means for forcing said second transfer roller against said photoconductor, so that said second nip is formed under pressure.

4. The system of claim 1 wherein the heat and pressure applied to said medium causes said toner on said photoconductor to be heated above its melt temperature, thereby softening said toner.

5. The system of claim 4 wherein said medium is allowed to remain against said photoconductor after passing through said second nip to allow for cooling and adhesion of the toner to said medium, and is thereafter detached from said photoconductor, whereby the image separates at the interface between the toner and the photoconductor.

6. The system of claim 1 wherein said photoconductor comprises a photoconductor drum.

7. The system of claim 1 wherein said guiding means comprises a block member fitting adjacent said nip between said transfer rollers, said block member having a surface which conforms generally to the curvature of said second roller, wherein the medium is guided between said second roller and said block member surface until said medium enters said second nip.

8. A thermo-electric image transfer system for directly transferring an image formed by liquid toner on a photoconductor to a sheet medium which has not been wetted with a liquid toner carrier, comprising:

a photoconductor drum carrying an image defined by liquid toner applied to the surface of said drum, said toner having an electrostatic polarity;

a heated platen over which a sheet medium onto which said image is fed;

first and second heated transfer rollers, defining a nip therebetween into which said medium is fed from said platen, providing a means for heating the image side of said medium to a temperature in excess of the melt temperature of said toner, the second of said rollers having an outer layer of an elastomeric material, said second roller being heated to provide a means for heating the backside of said sheet media;

means for guiding said medium out of said nip between said transfer rollers and into contact with said photoconductor drum, said guiding means maintaining contact between said elastomeric layer and said medium until said medium contacts said photoconductor drum at a second nip between said second roller and said drum; and means for applying an electrostatic voltage to said second roller which is opposite in polarity to that of said toner to provide an electrostatic attraction of the toner to said medium.

9. The system of claim 8 further comprising a paper feed belt for feeding said medium over said platen and into said first nip.

10. The system of claim 8 wherein said first heated transfer roller comprises a hollow metallic transfer roller coated with an elastomeric layer, and a transfer roller heat source disposed inside said hollow metallic transfer roller.

11. The system of claim 8 further comprising means for forcing said second transfer roller against said drum, so that said second nip is formed under pressure.

12. The system of claim 11 wherein said forcing means comprises a pneumatic cylinder applying a force tending to press said second roller against said drum surface.

13. The system of claim 8 wherein the heat and pressure applied to said medium causes said toner to be heated above its melt temperature, thereby softening said toner.

14. The system of claim 13 wherein said medium is allowed to remain against said drum after passing through said second nip to allow for cooling and adhesion of the toner to said medium, and is thereafter detached from said drum, whereby the image separates at the toner/photoconductor interface.

15. A method for directly transferring an image formed by liquid toner on a photoconductor to a sheet medium in the absence of a liquid toner carrier applied to the sheet medium, comprising a sequence of the following steps:

forming a liquid toner image on a photoconductor, said toner having an electrostatic polarity;

feeding said sheet medium into a nip defined by first and second heated transfer rollers to heat the image side of said medium to a temperature in excess of the melt temperature of said toner, the second of said rollers having an outer layer of a material which is thermally and electrically conductive;

applying an electrostatic voltage to said second roller which is opposite in polarity to that of said toner to provide an electrostatic attraction of the toner to said medium;

guiding said medium out of said nip between said transfer rollers and into contact with said photoconductor, while maintaining contact between said elastomeric layer and said medium until said medium contacts said photoconductor at a second nip between said second roller and said photoconductor.

16. The method of claim 15 further comprising means for forcing said second transfer roller against said photoconductor, so that said second nip is formed under pressure.

17. The system of claim 15 wherein the heat and pressure applied to said medium at said first and second nips causes said toner to be heated above its melt temperature when the medium is brought into contact with the toner image on said photoconductor, thereby softening said toner.

18. The system of claim 15 wherein said medium is allowed to remain against said photoconductor after passing through said second nip to allow for cooling and adhesion of the toner to said medium, and is thereafter detached from said photoconductor, whereby the image separates at the toner/photoconductor interface and adheres to the medium.

* * * * *